US005911782A

United States Patent [19]

Drigani et al.

[11] Patent Number: 5,911,782

[45] Date of Patent: Jun. 15, 1999

[54] COMPENSATION DEVICE FOR CHOCKS IN FOUR-HIGH ROLLING MILL STANDS WITH CROSSED DISPLACEMENT OF THE ROLLS

[75] Inventors: Fausto Drigani, Zugliano -Pozzuolo Del Friuli; Giacinto Dal Pan, Cellatica, both of Italy

[73] Assignee: Danieli & C. Officine Meccaniche SpA, Buttrio, Italy

[21] Appl. No.: 08/880,921

[22] Filed: Jun. 24, 1997

[30] Foreign Application Priority Data

Jun. 24, 1996 [IT] Italy ..... UD96A0108

[51] Int. Cl.[6] ..... B21B 31/00

[52] U.S. Cl. ..... 72/237; 72/241.8

[58] Field of Search ..... 72/237, 240, 241.2, 72/241.4, 241.6, 241.8, 242.4, 247

[56] References Cited

U.S. PATENT DOCUMENTS

| | | | |
|---|---|---|---|
| 5,365,764 | 11/1994 | Kajiwara et al. | 72/237 |
| 5,655,398 | 8/1997 | Ginzburg | 72/241.8 |
| 5,657,655 | 8/1997 | Yasuda et al. | 72/241.4 |
| 5,666,837 | 9/1997 | Kajiwara et al. | 72/241.4 |

FOREIGN PATENT DOCUMENTS

| | | | |
|---|---|---|---|
| 0707902 | 4/1996 | European Pat. Off. . | |
| 19512929 | 5/1996 | Germany . | |
| 4-59107 | 2/1992 | Japan | 72/237 |
| 4-162904 | 6/1992 | Japan | 72/237 |
| 5-317933 | 12/1993 | Japan | 72/241.8 |
| 6-31306 | 2/1994 | Japan | 72/237 |
| 6-31307 | 2/1994 | Japan | 72/237 |
| 6-134505 | 5/1994 | Japan | 72/241.8 |
| 6-226304 | 8/1994 | Japan | 72/237 |

OTHER PUBLICATIONS

Patent Abstracts of Japan vol. 008 No. 148 (M–309) Jul. 11, 1984 & JP 59 045009 A (Mitsubishi) Mar. 13, 1984 –abstract.

Patent Abstracts of Japan vol. 008 No. 238 (M–335) Oct. 31, 1984 & JP59 118209A (Mitsubishi) Jul. 7, 1984 –Abstract.

Patent Abstracts of Japan vol. 009 (M–418) Oct. 2, 1985 & JP60 099405 Jun. 3, 1985 abstract.

Patent Abstracts of Japan vol. 008 No. 227 (M–332) Oct. 18, 1984 & JP59 110406 Jun. 26, 1984 abstract.

Patent Abstracts of Japan vol. 018 No. 51 (M–1548) Jan. 26, 1994 & JP 05277525 Mar. 13, 1993 abstract.

*Primary Examiner*—Joseph J. Hail, III
*Assistant Examiner*—Ed Tolan
*Attorney, Agent, or Firm*—Antonelli, Terry, Stout & Kraus, LLP

[57] ABSTRACT

Compensation device for chocks in four-high rolling mill stands (13) with pair crossing of the rolls (12,112,14,114), the device (10) cooperating with the opposed sides of at least one chock (11) of at least one back-up roll (12, 14), the rolling mill stand (13) comprising a stationary housing (16) and means (21) to transmit a load force ("P") acting substantially on the longitudinal median plane of the stand (13) and contrasting the force of thrust ("S"), the transmission means (21) being located between the stationary housing (16) and the relative chock (11), the rolls (12, 14) including at least a crossover position wherein the load force ("P") defines an eccentricity ("e") with respect to the force of thrust ("S"), the device comprising actuator means (15,115) associated with at least one face of at least one chock (11) and exerting on the chock (11) a push-and-pull action associated functionally with the actual crossover position of the relative roll (12) in relation to the longitudinal median plane passing through the center line of the rolling mill stand (13) and/or functionally associated with the value of the eccentricity ("e").

8 Claims, 2 Drawing Sheets

COMPENSATION DEVICE FOR CHOCKS IN FOUR-HIGH ROLLING MILL STANDS WITH CROSSED DISPLACEMENT OF THE ROLLS

BACKGROUND OF THE INVENTION

This invention concerns a compensation device for chocks in four-high rolling mill stands with crossed displacement of the rolls.

The device is used to compensate for the crossover moment acting on the chocks of the back-up rolls and the working rolls as they cross over in four-high rolling mill stands.

The state of the art covers the rolling technique which includes the crossed displacement of the back-up rolls and/or working rolls (pair crossing) in order to obtain a better control of the profile of the rolled product during the processing step and therefore a final product of a better quality.

During the crossed displacement step, on the chocks of the back-up rolls, a moment of traversing is generated, caused by the misalignment of the forces of thrust which the rolled product imparts to the rolls with respect to the load exerted by the hydraulic pressure means and which act on the chocks of the back-up rolls.

This moment of traversing generates considerable friction between the chocks of the back-up rolls and the guide elements of the chocks, which are generally attached to the stationary uprights of the rolling mill stand, and this causes a greater rate of wear in the uprights and poor functioning in the whole rolling assembly.

This friction, and particularly that relating to the back-up roll situated on the side of the system to regulate the thickness of the rolled product (millscrews, capsules, etc.), considerably increases the mechanical hysteresis of the system which automatically regulates the thickness.

In these conditions, it is practically impossible to control the thickness and the profile of the rolled product with precision, and therefore the products obtained are not of optimum quality.

The Applicant is not aware of any experiments in the prior art which have tried to solve this problem or proposed solutions thereto.

As described in for example EP-A-0.707.902 and JP 60-099405, the use of thrust or lifting means which act on the side faces of the supporting chocks of the rolling rolls has been known for some time; however the function of these means has always been either to impress a desired camber lengthwise to the roll, or to absorb the curving reaction of the roll caused by the rolling passes.

For this reason, the prior art has never thought of correlating the push-and-pull action on the ends of the rolls to the actual crossover position of the rolls with respect to the rolling axis or to the misalignment with respect to the median plane of the rolling mill stand.

SUMMARY OF THE INVENTION

The present applicants have designed, tested and embodied this invention to overcome the shortcomings of the state of the art and to achieve further advantages.

The purpose of the invention is to provide a device to compensate for the moment of traversing acting on the chocks of the back-up rolls in rolling mill stands with pair crossing displacement. This device is designed to make the moment of traversing substantially ineffective during the processing cycle, and thus makes it possible to carry out correctly the appropriate adjustments on the components of the rolling assembly in order to achieve an accurate control of the thickness of the rolled product and at the same time to reduce the friction which is generated between the chocks and the guide elements of the chocks.

This compensation device can be applied only in cooperation with the upper back-up roll or, in a variant, with both the back-up rolls of the rolling mill stand.

According to a first embodiment of the invention the compensation device comprises a pair of actuators, attached to the stationary housing of the rolling mill stand and each one acting on one side of a respective chock.

According to a variant, the actuators are arranged symmetrically on opposite sides of the median plane of the rolling mill stand containing the longitudinal axes of the rolls.

According to another variant, there is a pair of actuators for each of the two chocks of a back-up roll.

In a first embodiment, this pair of actuators acts with a push-and-pull movement in correspondence with the upper outer face of the chocks.

According to a variant, the actuators are attached to the uprights of the rolling mill stand and act in correspondence with the outer lower face of the chocks of the upper back-up roll.

In both solutions, according to a variant, each of these actuators has an independent adjustment system so that they can be activated in a reciprocally differentiated manner and with differentiated working pressures.

According to a variant of the invention the two actuators are connected to a control unit which monitors the parameters relative to the working conditions and the crossover position of the rolls, in particular the entity of the misalignment and the rolling force. It activates the actuators with a differentiated push-and-pull action on the two ends of the roll according to the intensity and direction of the moment of traversing acting on the relative chocks.

The action of the compensation system according to the invention substantially cancels the unbalancing effect of this moment of traversing, thus making it possible to obtain almost optimum rolling conditions and considerably reducing the friction between the upper back-up roll and the relative chocks with a consequent reduced wear of the components of the latter, and also reduced deviations from the desired thickness.

The action of the actuator means also assumes a function of balancing the upper back-up roll.

BRIEF DESCRIPTION OF THE DRAWINGS

The attached figures are given as a non-restrictive example and show two preferred embodiments of the invention as follows.

DETAILED DESCRIPTION OF THE PREFERRED EMBODIMENTS

Figure 2:
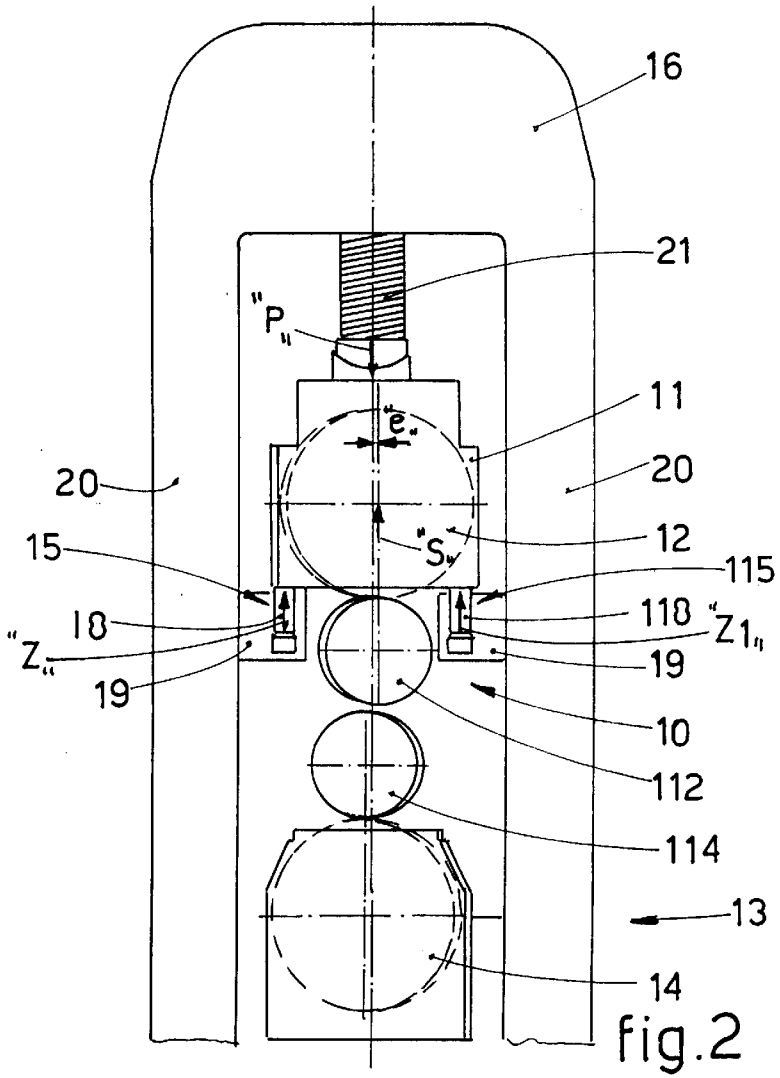
FIG. 2 is a diagram of a variant of FIG. 1.

The reference number 10 in the attached figures denotes generally the compensation device for chocks 11 according to the invention.

The attached figures are used as an example, in the case of the device being applied to the upper back-up roll 12 of a four-high rolling mill stand 13 with a first pair of rolls, a back-up roll 12 and a working roll 112, and a second opposite pair, respectively a back-up roll 14 and a working roll 114.

According to a variant which is not shown here, there is a similar compensation device 10 in cooperation with the lower back-up roll 14.

The compensation device 10 is used, for each of the ends of the relative back-up roll 12, to contrast and/or make substantially ineffective the influence of the moment of traversing acting on each chock 11 generated by the misalignment or eccentricity "e" of the thrust force "S" of the rolled product passing through with respect to the load force "P" exerted on the chock 11 by the adjustment means 21.

This eccentricity "e" is caused by the pair crossing which the back-up and working rolls assume in the course of rolling.

Figure 1:
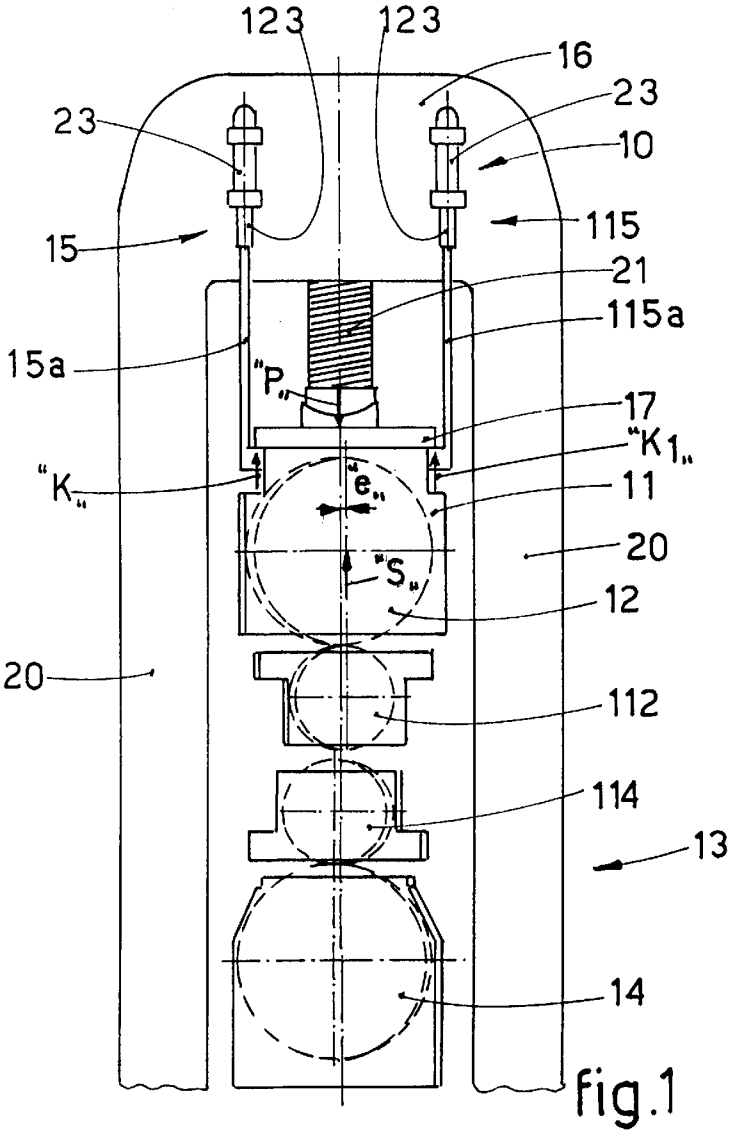
FIG. 1 is a diagram of the compensation device for the chocks of back-up rolls in four-high rolling mill stands according to a first embodiment of the invention.
Figure 4:
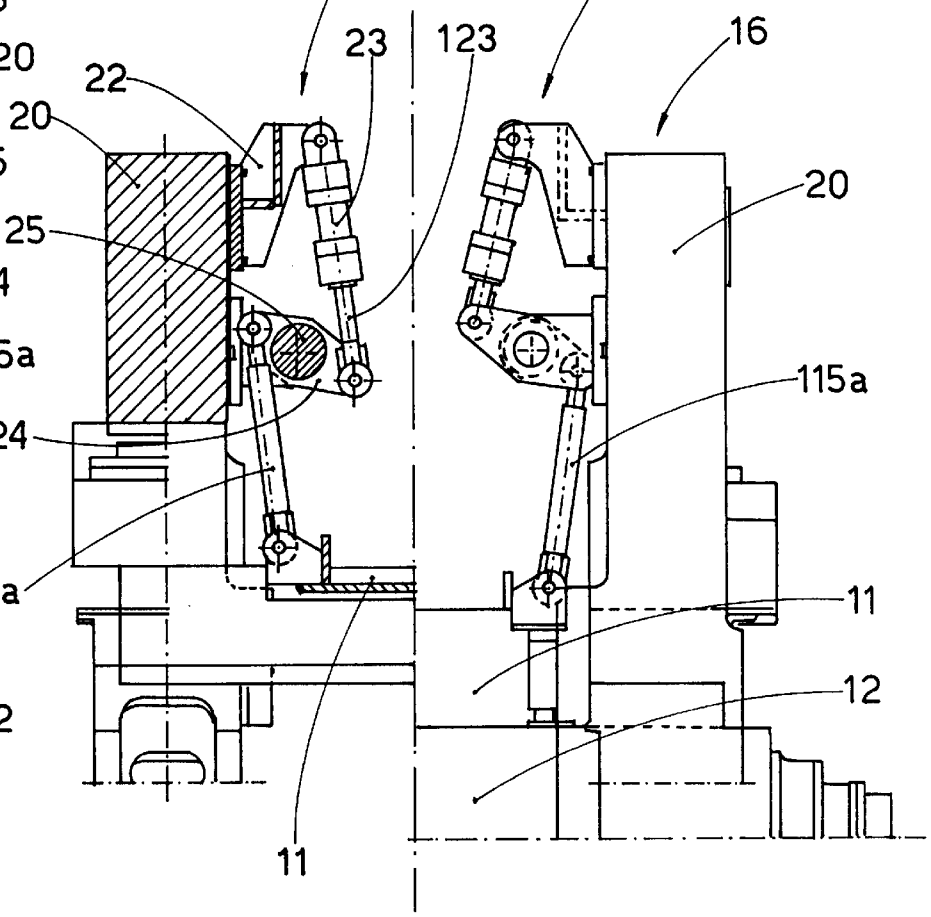
FIGS. 3 and 4, respectively from the front and from the side in a partial cross-section, an embodiment of the invention achieving the device shown in FIG. 1.
Figure 3:
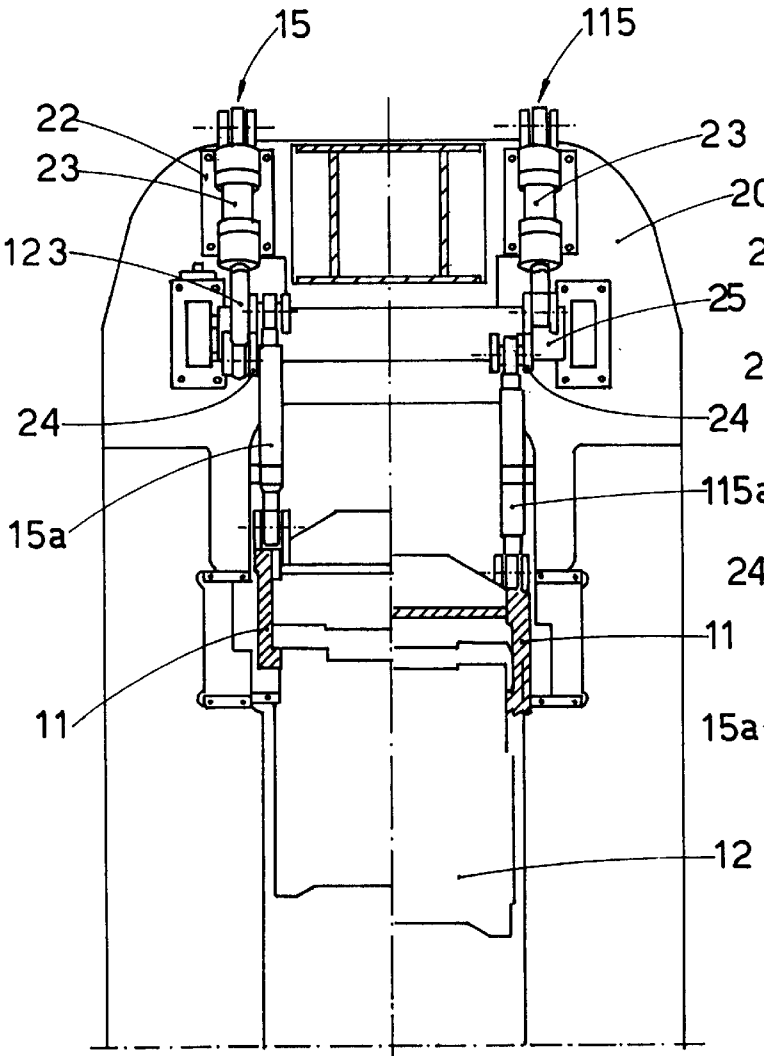

According to a first embodiment of the invention as shown diagrammatically in FIG. 1 and in greater detail in FIGS. 3 and 4, the compensation device 10 comprises a pair of actuators 15, 115, in this case hydraulically driven, acting on each of the two chocks 11 in correspondence with the outer upper face of the chocks 11.

In this case the two actuators 15, 115 consist of jacks 23, with a rod 123, are attached to the stationary housing 16 of the rolling mill stand 13 in a symmetrical position with respect to the median vertical plane of the stand, and act, with a drawing action which generates forces indicated respectively as "K" and "K1", on a plate element 17 which is made solid with the chock 11 by means of the relative arms 15*a*, 115*a*; the plate element 17 can slide laterally in relation to these arms.

According to the invention, the actuators 15, 115 have a reciprocally independent drive system and are connected to a control and command unit, not shown here, which is able to monitor the working conditions of the rolling assembly and the values of the load force "P", the thrust force "S", and the eccentricity "e".

According to these parameters the control and command unit activates in a differentiated manner the actuators 15, 115, particularly by altering the respective working pressures, moving the chock 11 in such a way as to contrast and make substantially ineffective the action of the moment of traversing acting on the chock 11.

The differentiated pressure exerted on the two opposite sides of the chock 11 has the effect of compensating the traversing movement deriving from the misalignment between the load "P" and force of thrust "S" due to the passage of the rolled product.

In the embodiment shown in FIGS. 3 and 4 the actuators 15, 115 are anchored to the respective uprights 20 of the stationary housing 16 by means of an assembly flange 22 and comprise a respective jack 23 with a rod 123 anchored on one end of an oscillating lever element 24 pivoted at 25.

One end of the arm 15*a* is anchored at the other end of the oscillating lever element 24; the other end of the arm 15*a* is anchored to the chock 11 on which the upper back-up roll 12 is assembled.

According to a variant of the invention shown in FIG. 2, the compensation device 10 comprises a pair of actuators 15, 115 consisting of jacks 18, 118, thrusting against the lower outer face of each of the two chocks 11, to which they remain clamped even during the crossed displacement step of the relative back-up roll 12; in FIG. 2, for reasons of practicality, the chocks of the working rolls 112, 114 are not shown.

In this case, the two jacks 18, 118 are of the hydraulically driven type, and are attached to two bracket elements 19 solid with the uprights 20 of the rolling mill stand 13.

According to the invention the jacks 18, 118 are functionally and operatively analogous to the jacks 23, and, according to commands given by a control unit, exert a differentiated thrust action, generating forces indicated respectively as "Z", "Z1", on the chock 11 in order to contrast and/or make substantially ineffective the moment of traversing acting on the chock 11, as caused by the misalignment between the load "P" and the force of thrust "S" in the crossed over position of the rolls 12,112 with respect to the vertical median plane of the rolling mill stand.

We claim:

1. Compensation device for chocks in four-high rolling mill stands with pair crossing of the rolls, the device cooperating with opposed sides of at least one chock of at least one back-up roll, the rolling stand comprising a stationary housing and means to transmit a load force acting substantially on a, longitudinal median plane of the stand substantially perpendicular to a running plane of a rolled product and contrasting a force of thrust S, of the rolled product, the transmission means being located between the stationary housing and the relative chock, the rolls including at least a crossover position wherein the load force P defines an eccentricity e with respect to the force of thrust S, the device being characterized in that it comprises actuator means associated with at least one face of at least one chock and exerting on the chock a push-and-pull action substantially perpendicular to the running plane and associated functionally with the actual crossover position of the relative roll in relation to the longitudinal median plane passing through the centre line of the rolling mill stand and/or functionally associated with the value of the eccentricity e.

2. Device as in claim 1, in which the actuator means comprise, for each chock, a pair of jack screws attached to the stationary housing of the rolling mill stand and cooperating with the upper face of the relative chocks.

3. Device as in claim 1, in which the actuator means comprise, for each chock, a pair of jack screws attached to the side uprights of the rolling mill stand and cooperating with the lower face of the relative chock.

4. Device as in claim 1, in which the actuator means are arranged symmetrically with respect to the longitudinal median plane of the rolling mill stand.

5. Device as in any claim 1, in which the actuator means have the function of balancing the upper back-up roll.

6. Device as in claim 1, which comprises a control and coordination unit for the action and the working pressure of the actuator means.

7. Device as in claim 6, in which the control unit receives as input at least signals relative to the force of thrust S of the rolled product passing through, the load force P imparted to the chocks, the misalignment or eccentricity e and the actual forces of push-and-pull movement exerted by the actuators.

8. A four-high rolling mill stand for rolling rolled product, comprising:

a pair of stationary housings;

a pair of working rolls supported between the pairs of stationary housings and defining a running plane for rolled product therebetween;

a pair of back-up rolls supported by chocks between the pair of stationary housings, the pair of back-up rolls and the pair of working rolls being cross displaced;

an adjustment device for transmitting a load force P to the chock of at least one back-up roll in a direction toward and substantially perpendicular to the running plane and contrasting a force of thrust S of the rolled product, wherein the force of thrust S is in a direction away from and substantially perpendicular to the running plane and misaligned from the load force P by an eccentricity value e;

a compensation device comprising a pair of actuators acting on at least one face of at least one chock of the at least one back-up roll and exerting a push-and-pull action substantially perpendicular to the running plane to compensate for the eccentricity e.

* * * * *